US010005636B2

(12) United States Patent
López Marin

(10) Patent No.: US 10,005,636 B2
(45) Date of Patent: Jun. 26, 2018

(54) DEVICE FOR AUTOMATICALLY UNWINDING WEB-SHAPED MATERIALS AND METHOD FOR OPERATING SUCH A DEVICE

(71) Applicant: Jesus López Marin, Mömbris (DE)

(72) Inventor: Jesus López Marin, Mömbris (DE)

(73) Assignee: PSA Technology S.Á.R.L., Echtemach (LU)

( * ) Notice: Subject to any disclaimer, the term of this patent is extended or adjusted under 35 U.S.C. 154(b) by 120 days.

(21) Appl. No.: 14/915,406

(22) PCT Filed: May 20, 2014

(86) PCT No.: PCT/EP2014/060305
§ 371 (c)(1),
(2) Date: Feb. 29, 2016

(87) PCT Pub. No.: WO2015/028159
PCT Pub. Date: Mar. 5, 2015

(65) Prior Publication Data

US 2016/0207727 A1 Jul. 21, 2016

(30) Foreign Application Priority Data

Aug. 30, 2013 (DE) ..... 10 2013 109 427

(51) Int. Cl.
*B65H 19/12* (2006.01)
*B65H 16/02* (2006.01)
(Continued)

(52) U.S. Cl.
CPC ..... *B65H 19/12* (2013.01); *B65H 16/02* (2013.01); *B65H 16/106* (2013.01); *B65H 19/18* (2013.01);
(Continued)

(58) Field of Classification Search
CPC ..... B65H 19/12; B65H 19/18; B65H 16/02; B65H 16/106
See application file for complete search history.

(56) References Cited

U.S. PATENT DOCUMENTS 6,719,240 B2 * 4/2004 Hanson ..... B65H 16/103 242/554.6
2003/0089817 A1 5/2003 Hanson et al.
(Continued)

FOREIGN PATENT DOCUMENTS

| | | | |
|---|---|---|---|
| EP | 0872440 | A2 | 10/1998 |
| WO | 2004080867 | A2 | 9/2004 |
| WO | 2015028159 | A1 | 3/2015 |

OTHER PUBLICATIONS

Certified German Patent Application No. 10 2013 109 427.9 filed on Aug. 30, 2013.
(Continued)

*Primary Examiner* — Sang K Kim
(74) *Attorney, Agent, or Firm* — Conley Rose, P.C.; Keith C. Rawlins

(57) ABSTRACT

A device for automatically unwinding web-shaped materials (8) from a master roll (3), and to a method for operating a device of this type are disclosed. The device has an infeed arm (2) and a first drive unit (6), wherein the master roll (3) by way of the winding core (4) thereof is rotatably mountable on the infeed arm (2), and the first drive unit (6) serves for introducing a driving force into the master roll (3). In order for high productivity to be achieved, the unwinder (1) has an outfeed arm (13) to which a second drive unit (14) for introducing a driving force into the master roll (3) is assigned, wherein the master roll (3) during an unwinding procedure is transferable from the infeed arm (2) to the outfeed arm (13). The material web (8) is then unwound from the master roll (3) which is mounted on the infeed am
(Continued)

(2) down to a predefinable minimum diameter, wherein during the ongoing unwinding procedure the master roll (3) is subsequently transferred to the outfeed arm (13) and thereon is further actively unwound, wherein a new master roll (3') is received by the infeed arm (2). Unwinding without interruption is thus enabled.

12 Claims, 5 Drawing Sheets

(51) Int. Cl.
*B65H 16/10* (2006.01)
*B65H 19/18* (2006.01)

(52) U.S. Cl.
CPC ..... *B65H 2301/41358* (2013.01); *B65H 2402/31* (2013.01); *B65H 2404/2692* (2013.01); *B65H 2404/2693* (2013.01); *B65H 2801/84* (2013.01)

(56) References Cited

U.S. PATENT DOCUMENTS

2004/0118964 A1 6/2004 Long
2014/0326822 A1* 11/2014 Morelli ..... B65H 16/106
242/555.3

OTHER PUBLICATIONS

Foreign communication from a related counterpart application—International Search Report and Written Opinion, English translation, PCT/EP2014/060305, dated Aug. 11, 2014, 7 pages.

Foreign communication from a related counterpart application—International Preliminary Report on Patentability, English translation, PCT/EP2014/060305, dated Mar. 1, 2016, 5 pages.

* cited by examiner

DEVICE FOR AUTOMATICALLY UNWINDING WEB-SHAPED MATERIALS AND METHOD FOR OPERATING SUCH A DEVICE

CROSS-REFERENCE TO RELATED APPLICATIONS

This application is a filing under 35 U.S.C. 371 of International Application No. PCT/EP2014/060305 filed May 20, 2014, entitled "Device for Automatically Unwinding Web-Shaped Materials and Method for Operating Such a Device," which claims priority to German Patent Application No. 10 2013 109 427.9 filed Aug. 30, 2013, which applications are incorporated by reference herein in their entirety.

FIELD OF INVENTION

The invention relates to a device for automatically unwinding web-shaped materials according to the preamble of claim 1, which device hereunder will be referred to as an unwinder, and to a method for operating a device of this type, according to claim 9.

BACKGROUND

Devices or unwinders of this type, respectively, are employed in the manufacturing of web-shaped materials, for example. The material web is thereafter wound on a production line by a winder onto a winding core so as to form a master roll. The master roll here has comparatively large dimensions, for example a diameter of 2 m and more, and a web width of more than 2 m.

The completely wound master rolls are first temporarily stored in a transfer region which thus serves as a buffer. Subsequently, the master roll is unwound off line with the aid of an unwinder and cut to measure according to customers' specifications in a downstream cutting line, for example.

On account of the cutting line having the device for automatic unwinding, that is to say having the unwinder, operating in an offline manner, the production line during a temporally limited period may run at a higher production rate than the cutting line. Downtime is created by the required changeover of the master rolls in the unwinder. Here, after the winding core of the unwound master roll has been removed, an end of the material web of the new master roll has to be guided over by way of the unwinder to the downstream cutting line. This requires the intervention of at least one operator, bears a certain susceptibility to errors, and leads to downtime. Since the master roll has to be replaced every couple of hours, the efficiency of the entire line is negatively influenced by these occurrences of downtime.

SUMMARY OF INVENTION

The invention is now based on the object of providing a device and a method for efficient operation. In particular, downtime in the event of a changeover of the master roll is to be minimized or even completely eliminated.

According to the invention, this object is achieved by a device having the features of claim 1, and by a method having the features of claim 9. Advantageous design embodiments are to be found in the dependent claims.

In a device for automatically unwinding a material web from a master roll, having an infeed arm and at least one first drive unit, wherein the master roll by way of the winding core thereof is rotatably mountable on the infeed arm, and by way of the drive unit a driving force is introducible into the master roll, it is provided according to the invention that the unwinder has an outfeed arm to which at least one second drive unit for introducing a driving force into the master roll is assigned, wherein the master roll during an unwinding procedure is transferable from the infeed arm to the outfeed arm.

In an unwinder of this type the master roll may be mounted both on the infeed arm as well as on the outfeed arm, and be actively unwound by way of the first or second drive unit. During unwinding from the infeed arm on which the master roll is rotatably mounted at the beginning of the unwinding operation, the master roll is initially set in rotation only by the first drive unit and then transferred to the outfeed arm. The master roll is likewise rotatably mounted on the outfeed arm, and may there be further unwound, wherein the driving force required for rotation of the master roll is introduced by the second drive unit. The master roll here may also be unwound without interruption while being transferred from the infeed arm to the outfeed arm, for example in that the first drive unit continues to drive the master roll until the second drive unit assumes the task of driving. The infeed arm and the outfeed arm here are mounted in particular so as to be pivotable. While the master roll is being unwound on the outfeed arm and driven by way of the second drive unit, the infeed arm may already be pivoted and receive a new master roll which has been prepared for unwinding. Accordingly, the unwinder according to the invention enables unwinding without interruptions, without having to be stopped for a changeover of the master rolls. The throughput rate and the efficiency of the line are thus enhanced.

In one preferred refinement, the device has a contact roller which is placeable on a circumference of the master roll which in particular is mounted on the infeed arm, wherein the material web by way of the contact roller is guided away from the master roll and in the event of a displacement of the master roll and thus of a displacement of the rotation axis of the latter may be adapted. The contact roller here is in particular pivotably mounted on an arm and is disposed below the master roll, for example. The contact roller here need not necessarily be configured as a roller in the strict sense of the term but may also be formed by a revolving belt or similar, for example.

Preferably, the first drive unit on the infeed arm and/or the second drive unit on the outfeed arm are/is configured as a winding shaft drive which is in particular attached to the end side. With the aid of a winding shaft drive of this type the winding core of the master roll may be driven directly in the center. Optionally it may also be provided that in each case one winding shaft drive is provided at each end side. On account thereof, it is possible for the master roll to be set in rotation, without establishing physical contact with the material web and stressing the material web with a driving force.

Alternatively or additionally, it may be provided that the first drive unit on the infeed arm is configured as a first drive swing arm and/or the second drive unit on the outfeed arm is configured as a second drive swing arm. A drive swing arm is placeable by way of pivoting on a circumference of the master roll and may in this way introduce a driving force for rotating the master roll and thus for unwinding the material web. Since the drive swing arm is placed on the circumference of the master roll, it is very simple in terms of control technology for a winding speed to be kept constant. The first drive swing arm here is in particular disposed above the master roll, the material web being unwound from the master roll in a downward manner.

Preferably, the first drive swing arm and/or the second drive swing arm have/has one or a plurality of belt drives. A belt drive here may comprise one or a plurality of belts. A belt drive may be placed on the circumference of the master roll across a comparatively large area and in this way cause good transmission of force. Therefore, the material web may also be composed of comparatively delicate materials.

In particular, the first drive swing arm is placeable on the master roll from above. A fulcrum of the drive swing arm here may in particular lie above a motion path of the fulcrum of the master roll. The second drive swing arm is then located below the first drive swing arm, since the former is employed only in the case of a diameter of the master roll which has been reduced as a consequence of unwinding. The second drive swing arm here is guided toward the master roll in particular in a lateral manner or from above, when said master roll is being transferred to the outfeed arm or has been transferred thereto, respectively.

In one preferred refinement, the unwinder has a cutting installation which in particular is configured as a cutting blade having a counter-impact strip. By way of this cutting installation the material web may be severed in a manner transverse to the web running direction, such that a remainder of the material web may remain on the otherwise unwound winding core. To this end, the cutting installation acts on the material web in particular between the outfeed arm or between the master roll which is mounted on the outfeed arm, respectively, and the contact roller. The cut through the material web may then be located in regions which may be relatively easily supplied to any waste. For example, it is avoided in this way that a cut of this type comes to lie in a roll which has already been finished to size.

Preferably, the unwinder has a roll storage stand from which a newly provided master roll is receivable by the outfeed arm. The new master roll here is made available on the roll storage stand, while the preceding master roll is still being unwound. The new master roll here emanates from the transfer region or from the buffer, respectively, so that waiting for a new master roll, which would lead to an interruption of the unwinding procedure, is avoided.

Advantageously, the device has an outfeed installation by way of which the unwound winding core is removable from the outfeed arm. The winding core here need not be completely unwound but may still have a few coilings of the material web, for example. The outfeed installation here may convey the winding core away from the outfeed arm in an upward or lateral manner, for example.

The object is achieved according to the invention by a method for operating a device for automatically unwinding a material web from a master roll in that the material web is unwound from the master roll which is mounted on the infeed arm down to a predefinable minimum diameter, wherein during the ongoing unwinding procedure the master roll is subsequently transferred to the outfeed arm and thereon is further unwound, wherein a new master roll is received by the infeed arm. Continuous operation of the unwinder is thus performed. It may optionally be provided here that the winding speed is adapted during transfer from the infeed arm to the outfeed arm and/or during start-up of the winding procedure, using a new master roll. The master roll may be actively unwound both when said master roll is mounted on the outfeed arm as well as on the infeed arm, that is to say said master roll may be driven in each case by way of at least one drive unit. Continuous unwinding is thus possible in either position.

Preferably, for transferring the master roll, the infeed arm and the outfeed arm are converged, wherein in particular driving by way of the first drive swing arm is performed at least until the master roll is mounted on the outfeed arm and driven by the second drive unit. It may be provided here that only the infeed arm is moved and that the outfeed arm is held in an immovable manner.

In one preferred refinement, an end of the material web that is unwound from the master roll which is mounted and in particular driven on the outfeed arm is spliced to a lead end of the new master roll which is mounted and driven on the infeed arm, wherein to this end in particular the material web emanating from the master roll which is mounted on the outfeed arm is pressed onto the circumference of the new master roll by a contact roller. The end of the material web on the almost unwound master roll is connected in this way to the lead end or to the external wound layer of the material web on the new master roll, respectively. This procedure is simplified by the use of a double-sided adhesive tape, for example. A fixed connection across a comparatively large area is performed here in that a corresponding contact pressure is applied with the aid of the contact roller. Threading of a new lead end of a material web is thus not required, but continuous operation may rather be performed. Complete automation is thus also possible, without intervention by an operator being required. On account of both master rolls being simultaneously driven, no relative speed and thus no friction arises here when the material webs are mutually compressed with the aid of the contact roller.

Features and advantages which have been described in the context of the unwinder may also be applied in a corresponding manner to the method. The same applies to features and advantages which have been described in the context of the method.

BRIEF DESCRIPTION OF DRAWINGS

The invention will be described in more detail hereunder by means of a preferred exemplary embodiment in conjunction with the drawings in which.

DETAILED DESCRIPTION OF INVENTION

Figure 1:
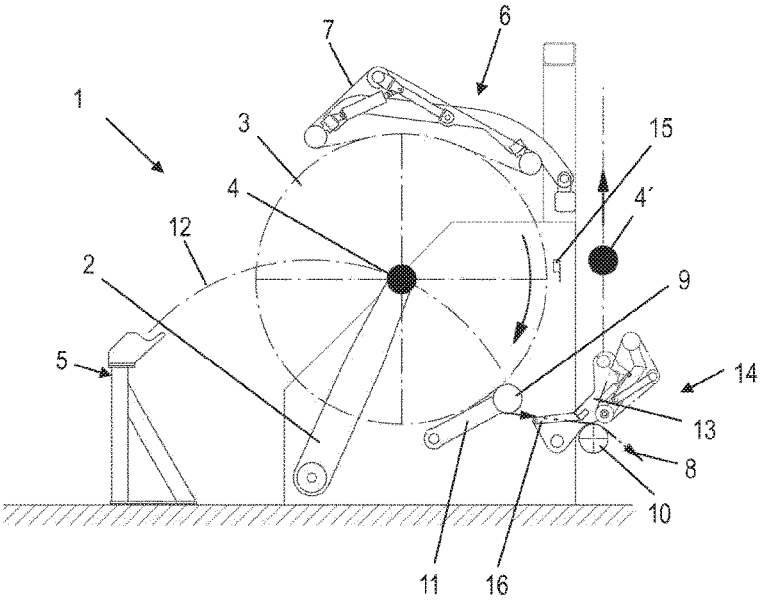
FIGS. 1 to 9 show a side view of a device for automatically unwinding a material web at various points in time during an unwinding procedure.

A device for automatically unwinding a material web, that is to say an unwinder 1, which has an infeed arm 2 on which a master roll 3 having a winding core 4 is rotatably mounted is schematically shown in side view in the figures. A material web, for example from a non-woven material, is wound on the winding core 4. The master roll 3 is removed from a buffer or from a transfer region of a non-woven fabric production line, for example, and transferred to the infeed arm 2. A roll storage stand 5 on which a new master roll may be held in a standby position until the latter is acquired by the infeed arm 2 is provided for the transfer.

A first drive unit 6 configured as a first drive swing arm which is disposed above the master roll 3 or above the infeed arm 2, respectively, serves for generating rotation of the master roll 3. The first drive swing arm 6 has one or a plurality of belt drives 7 and is placed on a circumference of the master roll 3, in order for a force which is directed in the circumferential direction to be transmitted. Unwinding of the master roll 3 is performed in this way, wherein the material web 8 is guided by way of a contact roller 9 and a deflection roller 10 to a downstream cutting line, for example, or to another processing line. Additionally, it may be provided that a winding shaft drive in the form of a center drive which is mounted on the infeed arm, for example, and which engages directly on the winding core 4 is provided for driving the master roll 3. This, however, is not illustrated in the figures.

The contact roller 9 is pivotably mounted on an arm 11 and is capable of bearing on the circumference of the master roll 3 in order to provide contact pressure in particular. The infeed arm 2 is pivotably mounted, wherein a motion path 12 of a rotation axis of the master roll 3 is illustrated with dashed lines.

The unwinder 1 furthermore has an outfeed arm 13 which is pivotably mounted. The master roll 3 may be transferred from the infeed arm 2 to the outfeed arm 13, which to this end are pivoted so as to converge. The outfeed arm 13 is assigned a second drive unit 14 which is configured as a second drive swing arm and which is then placeable on the circumference of the master roll 3 when the master roll 3 is mounted on the outfeed arm 13. Accordingly, it is possible for the master roll to be actively unwound in a continuous manner, irrespective of whether said master roll is mounted on the infeed arm 2 or on the outfeed arm 13. Like the first drive swing arm 6, the second drive swing arm 14 may also have one or a plurality of belt drives.

A winding core 4' which has already been unwound and which is conveyed away from the unwinder 1 by an outfeed installation (not illustrated in more detail) is schematically illustrated in FIG. 1.

In order for the material web to be severed, the unwinder 1 has a cutting installation having a cutting blade 15 and a counter-impact strip 16. In this way the material web is severable in a manner transverse to the web running direction when the master roll is mounted on the outfeed arm 13. The cut is then performed between the master roll 3, which is mounted on the outfeed arm 13, and the contact roller 9.

The functional sequence of the unwinder will now be described in more detail, proceeding from FIG. 1.

Figure 2:
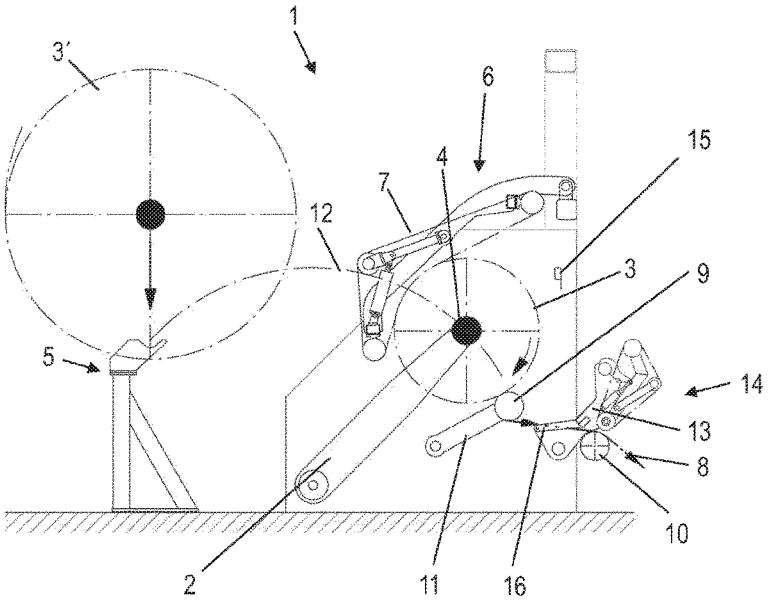

In FIG. 1 a master roll 3 is located on the infeed arm 2. The first drive swing arm 6 has been guided onto the circumference of the master roll 3, and the material web 8 is unwound by way of the contact roller 9 and of the deflection roller 10 and supplied to a cutting line (not illustrated). Once a diameter of the master roll has been reduced in a corresponding manner by unwinding of the master roll so as to make available sufficient space, a new master roll 3' is made available on the roll storage stand 5 (FIG. 2). Here, both the infeed arm 2 as well as the first drive swing arm 6 have already been pivoted in the direction of the outfeed arm 13, so as to enlarge the available space.

Figure 3:
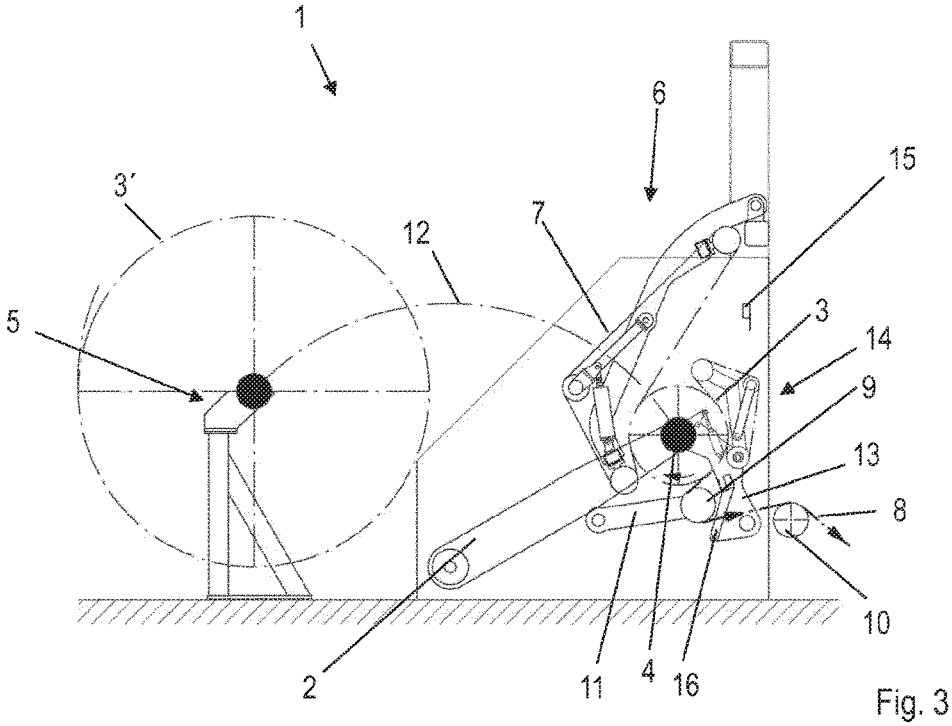

The point in time at which the master roll 3 is acquired by the outfeed arm 13 is now illustrated in FIG. 3. To this end, the outfeed arm 13 grips projecting ends of the winding core 4 and acquires the master roll 3, without interrupting rotation of the master roll 3. Driving of the master roll 3 is assumed by the second drive swing arm 14 which is assigned to the outfeed arm 13. Optionally, both the first drive swing arm 6 as well as the second drive swing arm 14 may bear on the circumference of the master roll for a brief period, so as to guarantee a continuous transition.

Figure 4:
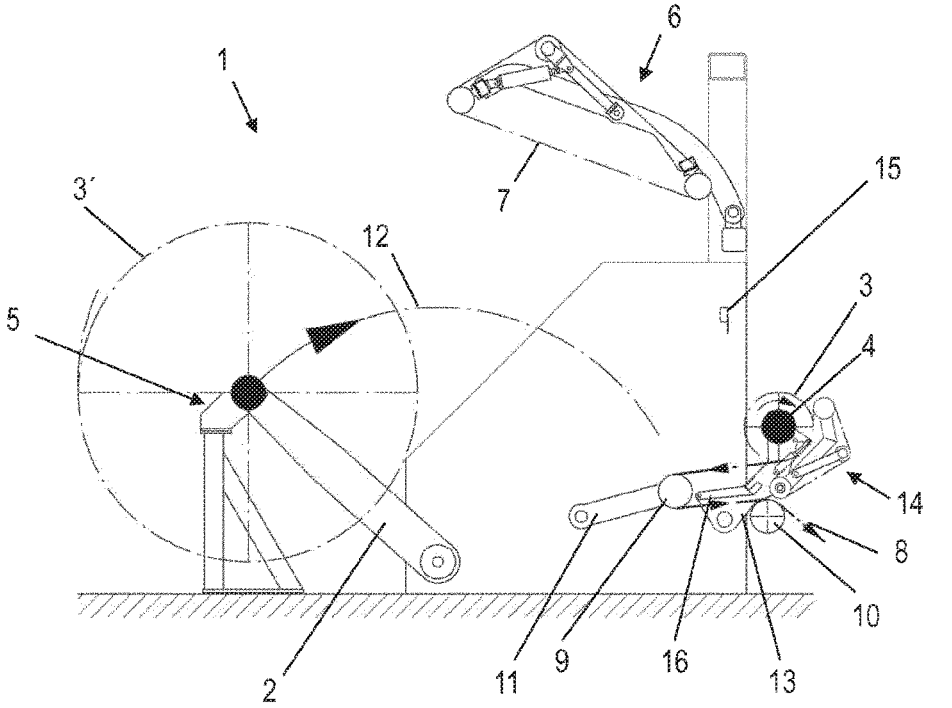
Figure 5:
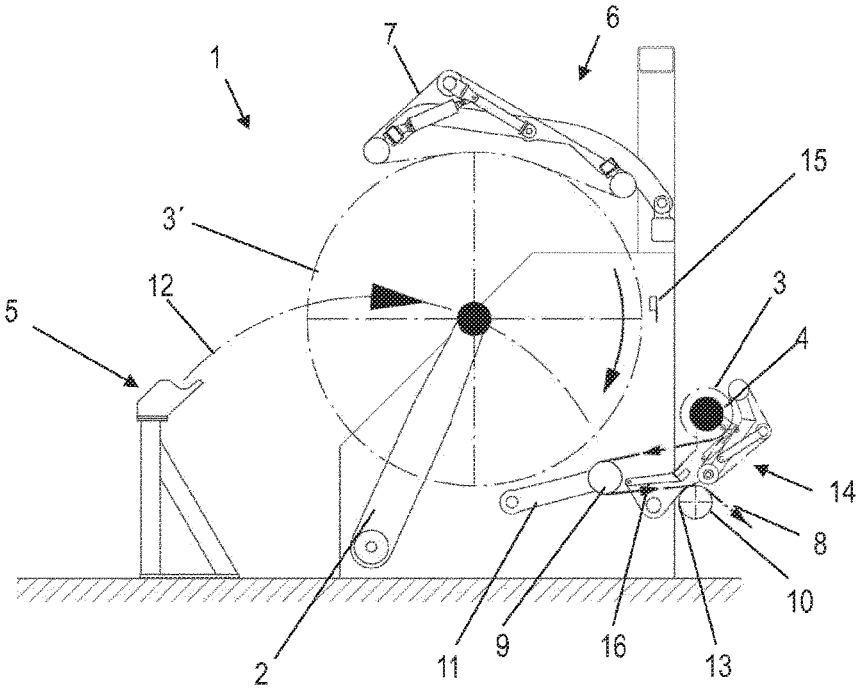

In FIG. 4 the master roll 3 is held by the outfeed arm 13 alone and is driven by the second drive swing arm 14, wherein drawing-off of the material web 8 continues to be performed via the contact roller 9 and the deflection roller 10. The infeed arm 2 is pivoted in the direction of the roll storage stand 5, so as to receive a new master roll 3'. The first drive swing arm 6 has been upwardly pivoted, so as to enable introduction of the new master roll 3 into an unwinding position. This is illustrated in FIG. 5. The new master roll 3' is ready for participating in the unwinding procedure. However, the material web is still being unwound from the previous master roll 3.

Figure 6:
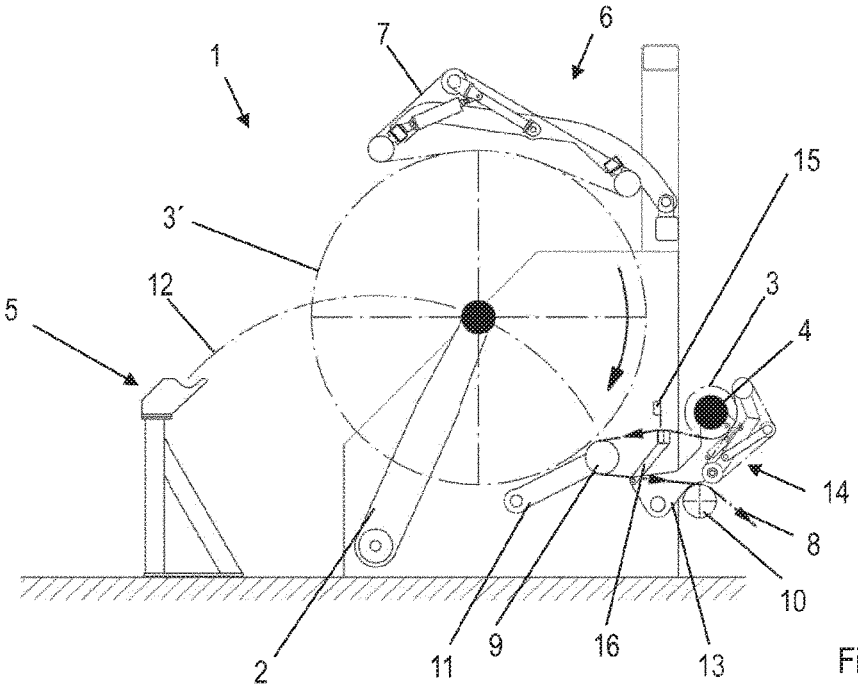

FIG. 6 now shows the beginning of a splicing procedure in which the material web emanating from the master roll 3 which is mounted on the outfeed arm 13 is spliced to the material web which is located on the new master roll 3'. This is performed with the aid of the contact roller 9 which mutually compresses the material webs and which generates the pressure forces required for configuring the spliced connection. At the same time, the cutting installation having the cutting blade 15 and the counter-impact strip 16 is prepared in order for a cut through the material web to be produced.

Figure 7:
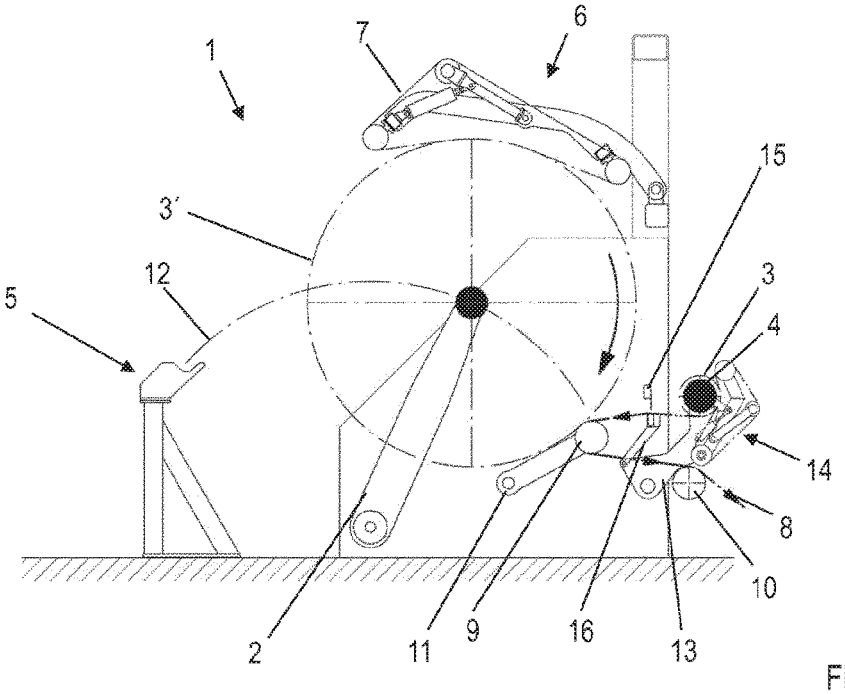

FIG. 7 now shows the actual splicing procedure, wherein an initially double-layered material web is drawn off downstream of the contact roller 9.

Figure 8:
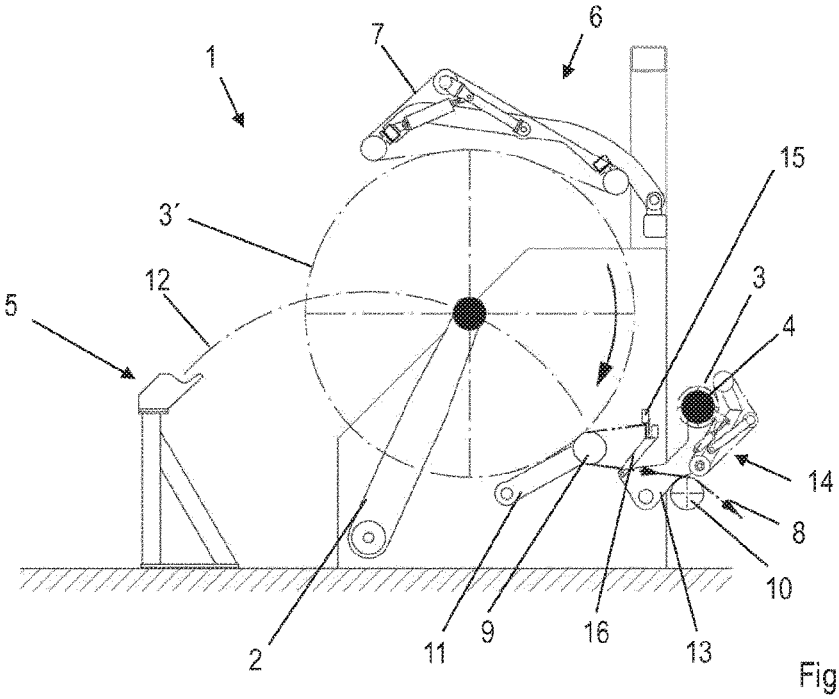
Figure 9:
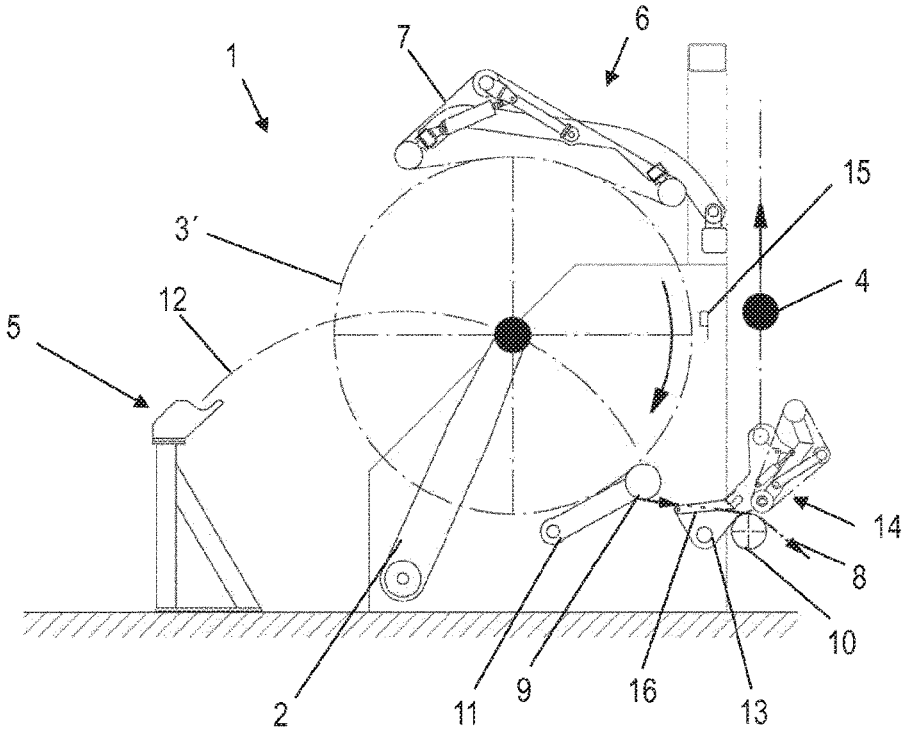

It is now illustrated in FIG. 8 how the material web emanating from the previous master roll 3 is severed by the cutting blade 15. Accordingly, the master roll 3 is completely unwound and may be removed, as is shown in FIG. 9. A lead end of the material web which is wound on the new master roll 3' is automatically discharged by way of the contact roller 9 and of the deflection roller 10, without any interruption taking place. The unwinder here is in the same position as is illustrated in FIG. 1. Accordingly, a new unwinding cycle commences.

Non-stop unwinding is possible by way of the method according to the invention and of the device according to the invention, respectively. It is provided here that active unwinding of the master roll is effected both on the unloading arm and on the infeed arm by way of respective drive units, that is to say that both positions are used for unwinding. In this way, a significant increase in efficiency results in particular in the case of offline plants such as employed in the manufacturing of non-woven fabrics. Downtime which to date has been necessary due to the changeover of the master roll may be entirely eliminated. Moreover, complete automation is possible.

The invention is not limited to any of the above-described embodiments but may be modified in a variety of manners.

All features and advantages, including construction details, spatial arrangements and method steps, which are derived from the claims, the description and the drawings may be relevant to the invention both individually and in various combinations thereof.

LIST OF REFERENCE SIGNS

1 Unwinder
2 Infeed arm
3 Master roll
3' New master roll
4 Winding core
4' Unwound winding core
5 Roll storage stand
6 First drive unit/First drive swing arm
7 Belt drive
8 Material web
9 Contact roller
10 Deflection roller
11 Arm

12 Motion path
13 Outfeed arm
14 Second drive unit/Second drive swing arm
15 Cutting blade
16 Counter-impact strip

The invention claimed is:

1. An unwinder for automatically unwinding a material web from a master roll, having an infeed arm and at least one first drive unit, wherein the master roll by way of a winding core thereof is rotatably mountable on the infeed arm, and by way of the drive unit a driving force is introducible into the master roll, wherein the unwinder has an outfeed arm to which at least one second drive unit for introducing a driving force into the master roll is assigned, wherein the master roll during an unwinding procedure is transferable from the infeed arm to the outfeed arm, and wherein said unwinder has a contact roller which is placeable on a circumference of the master roll which is mounted on the infeed arm, wherein the material web by way of the contact roller is guided away from the master roll.

2. The unwinder as claimed in claim 1, wherein the first drive unit on the infeed arm is configured as a winding shaft drive which is attached to the end side.

3. The unwinder as claimed in claim 1, wherein the first drive unit on the infeed arm is configured as a first drive swing arm.

4. The unwinder as claimed in claim 3, wherein the first drive swing arm has one or a plurality of belt drives.

5. The unwinder as claimed in claim 1, wherein said unwinder has a cutting installation which is configured as a cutting blade having a counter-impact strip.

6. The unwinder as claimed in claim 1, wherein said unwinder has a roll storage stand from which the master roll is receivable by the infeed arm.

7. The unwinder as claimed in claim 1, wherein said unwinder has an outfeed installation by way of which the unwound winding core is removable from the outfeed arm.

8. The unwinder as claimed in claim 1, wherein the second drive unit on the outfeed arm is configured as a winding shaft drive which is attached to the end side.

9. The unwinder as claimed in claim 1, wherein the second drive unit on the outfeed arm is configured as a second drive swing arm.

10. The unwinder as claimed in claim 9, wherein the second drive swing arm has one or a plurality of belt drives.

11. A method for operating an unwinder for automatically unwinding a material web from a master roll, having an infeed arm and at least one first drive unit, wherein the master roll by way of a winding core thereof is rotatably mountable on the infeed arm, and by way of the drive unit a driving force is introducible into the master roll, wherein the unwinder has an outfeed arm to which at least one second drive unit for introducing a driving force into the master roll is assigned, wherein the master roll during an unwinding procedure is transferable from the infeed arm to the outfeed arm, wherein the material web is unwound from the master roll which is mounted on the infeed arm down to a predefinable minimum diameter, wherein during the ongoing unwinding procedure the master roll is subsequently transferred to the outfeed arm and thereon is further unwound, wherein a new master roll is received by the infeed arm, wherein an end of the material web that is unwound from the master roll which is mounted and driven on the outfeed arm is spliced to a lead end of the new master roll which is mounted and driven on the infeed arm, wherein to this end the material web emanating from the master roll which is mounted on the outfeed arm is pressed onto a circumference of the new master roll by a contact roller.

12. The method as claimed in claim 11, wherein for transferring the master roll, the infeed arm is moved toward the outfeed arm, or the infeed arm and the outfeed arm are converged, wherein driving by way of the first drive unit is performed at least until the master roll is driven by the second drive unit.

* * * * *